US008272832B2

(12) United States Patent
Yin

(10) Patent No.: US 8,272,832 B2
(45) Date of Patent: Sep. 25, 2012

(54) CENTRIFUGAL COMPRESSOR WITH SURGE CONTROL, AND ASSOCIATED METHOD

(75) Inventor: Junfei Yin, Bedfordshire (GB)

(73) Assignee: Honeywell International Inc., Morristown, NJ (US)

( * ) Notice: Subject to any disclaimer, the term of this patent is extended or adjusted under 35 U.S.C. 154(b) by 1196 days.

(21) Appl. No.: 12/104,659

(22) Filed: Apr. 17, 2008

(65) Prior Publication Data

US 2009/0263234 A1 Oct. 22, 2009

(51) Int. Cl.
*F04D 29/44* (2006.01)

(52) U.S. Cl. ..... 415/58.4; 415/191; 415/206

(58) Field of Classification Search ..... 415/56.5, 415/58.4, 191, 206
See application file for complete search history.

(56) References Cited

U.S. PATENT DOCUMENTS 4,981,018 A * 1/1991 Jones et al. ..... 60/726
4,990,053 A * 2/1991 Rohne ..... 415/58.4
5,295,785 A * 3/1994 Church et al. ..... 415/58.3
5,308,225 A * 5/1994 Koff et al. ..... 415/57.3
7,775,759 B2 * 8/2010 Sirakov et al. ..... 415/1
2007/0271921 A1 11/2007 Chen

FOREIGN PATENT DOCUMENTS

WO WO0118404 3/2001
WO WO2007093367 8/2007

OTHER PUBLICATIONS

EP Search Report (Honeywell).

* cited by examiner

*Primary Examiner* — Ninh H Nguyen
(74) *Attorney, Agent, or Firm* — Alston & Bird LLP

(57) ABSTRACT

A centrifugal compressor for compressing a fluid comprises a compressor wheel having a plurality of circumferentially spaced blades, and a compressor housing in which the compressor wheel is mounted. The compressor housing includes an inlet duct through which the fluid enters in an axial direction and is led by the inlet duct into the compressor wheel, and an inner surface located radially adjacent the tips of the blades. A bleed port is defined in the inner surface of the compressor housing at a location intermediate the leading and trailing edges of the blades, for bleeding off a bleed portion of the fluid, the bleed port leading to a recirculation flow channel that feeds the bleed portion back into the inlet duct. Highly cambered vanes are disposed in the recirculation flow channel for turning the bleed portion to take out and in some cases reverse the swirl in the bleed portion.

10 Claims, 3 Drawing Sheets

CENTRIFUGAL COMPRESSOR WITH SURGE CONTROL, AND ASSOCIATED METHOD

CROSS-REFERENCE TO RELATED APPLICATION

The present application is related to U.S. patent application Ser. No. 10/583,937 filed on Jun. 22, 2006, and to U.S. patent application Ser. No. 11/696,294 filed on Apr. 4, 2007.

BACKGROUND OF THE INVENTION

The present disclosure relates to centrifugal compressors used for compressing a fluid such as air, and more particularly relates to centrifugal compressors and methods in which surge of the compressor is controlled by bleeding off a portion of the at least partially compressed fluid and recirculating the portion to the inlet of the compressor.

Centrifugal compressors are used in a variety of applications for compressing fluids, and are particularly suitable for applications in which a relatively low overall pressure ratio is needed. A single-stage centrifugal compressor can achieve peak pressure ratios approaching about 4.0 and is much more compact in size than an axial flow compressor of equivalent pressure ratio. Accordingly, centrifugal compressors are commonly used in turbochargers for boosting the performance of gasoline and diesel engines for vehicles.

In turbocharger applications, it is important for the compressor to have a wide operating envelope, as measured between the "choke line" at which the mass flow rate through the compressor reaches a maximum possible value because of sonic flow conditions in the compressor blade passages, and the "surge line" at which the compressor begins to surge with reduction in flow at constant pressure ratio or increase in pressure ratio at constant flow. Compressor surge is a compression system instability associated with flow oscillations through the whole compressor system. It is usually initiated by aerodynamic stall or flow separation in one or more of the compressor components as a result of exceeding the limiting flow incidence angle to the compressor blades or exceeding the limiting flow passage loading.

Surge causes a significant loss in performance and thus is highly undesirable. In some cases, compressor surge can also result in damage to the engine or its intake pipe system.

Thus, there exists a need for an improved apparatus and method for providing compressed fluid, such as in a turbocharger, while reducing the occurrence of compressor surge. In some cases, the prevention of compressor surge can expand the useful operating range of the compressor.

BRIEF SUMMARY OF THE DISCLOSURE

The present disclosure is directed to a centrifugal compressor having a fluid recirculation system aimed at controlling surge. In accordance with one embodiment disclosed herein, a centrifugal compressor for compressing a fluid comprises a compressor wheel having a plurality of circumferentially spaced blades, and a compressor housing in which the compressor wheel is mounted so as to be rotatable about the rotational axis of the compressor wheel. The compressor housing includes an inlet duct through which the fluid enters in a direction generally parallel to the rotational axis of the compressor wheel and is led by the inlet duct into the compressor wheel. The compressor housing defines a radially inner surface located adjacent and radially outward of the tips of the blades.

A bleed port is defined in the inner surface of the compressor housing at a location intermediate the leading and trailing edges of the blades, for bleeding off a bleed portion of the fluid being compressed by the compressor wheel. The bleed port leads into a recirculation flow channel that extends generally upstream with respect to the main flow through the compressor wheel. The recirculation flow channel has a discharge end that is positioned to discharge the bleed portion into the inlet duct.

A plurality of highly cambered vanes are disposed in the recirculation flow channel and are configured to alter a degree of swirl in the bleed portion prior to the bleed portion being discharged through the discharge end. The vanes can reduce the swirl of the bleed portion to zero before it is injected into the main fluid flow stream. Alternatively, the vanes can reverse the swirl direction such that the bleed portion is injected with a swirl opposite to the compressor wheel rotation (so-called "counter-swirl").

Each vane has a leading edge and a trailing edge with respect to the direction of flow through the recirculation flow channel. In accordance with the present disclosure, the vanes have a non-zero camber. The leading edges extend in a non-axial direction generally corresponding to a flow direction of the bleed portion at the leading edge. The trailing edges extend in a direction such that the bleed portion is guided by the vanes to have zero swirl or counter-swirl when exiting the discharge end of the recirculation flow channel. Accordingly, the vanes have a highly cambered or "cupped" shape in order to impart the necessary amount of flow turning to take out, and in some cases reverse, the swirl entering the bleed port.

The flow area of the bleed port can be sized such that at a predetermined operating condition the mass flow rate of the bleed portion comprises more than 5% of the total mass flow rate of the fluid entering the inlet duct, more particularly more than 10% of the total mass flow rate, and still more particularly more than 15% of the total mass flow rate.

In one embodiment, the discharge end of the recirculation flow channel is configured to inject the bleed portion in a direction that makes an angle of from 0° to 90° with respect to the rotational axis.

In one embodiment, a flow area of the recirculation flow channel decreases approaching the discharge end such that the bleed portion is accelerated before being injected into the main fluid flow stream.

In accordance with one embodiment, the recirculation flow channel has a generally C-shaped configuration in axial-radial cross-section. The open side of the C-shaped configuration faces radially inwardly.

The entrance region of the recirculation flow channel in the vicinity of the vane leading edges acts like a radial diffuser, in which the high-speed flow from the bleed port is diffused such that losses in the flow channel will be reduced. Additionally, the C-shaped flow channel causes the bleed portion to change flow direction gradually rather than abruptly, so as to avoid flow separation such that losses in the bleed portion are further reduced.

The vanes are highly cambered in order to impart the relatively large flow turning necessary to take out or reverse the swirl in the bleed portion. Because of the large camber of the vanes, a relatively high vane count is employed in order to minimize the loss in the recirculation flow channel. Generally, there is an optimal vane count that depends on the vane camber and the diameter of the compressor wheel. In preferred embodiments, the vane count is between 6 and 20. In some embodiments, the vane count is defined as between 0.7 and 1.3 times the number of compressor blades.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
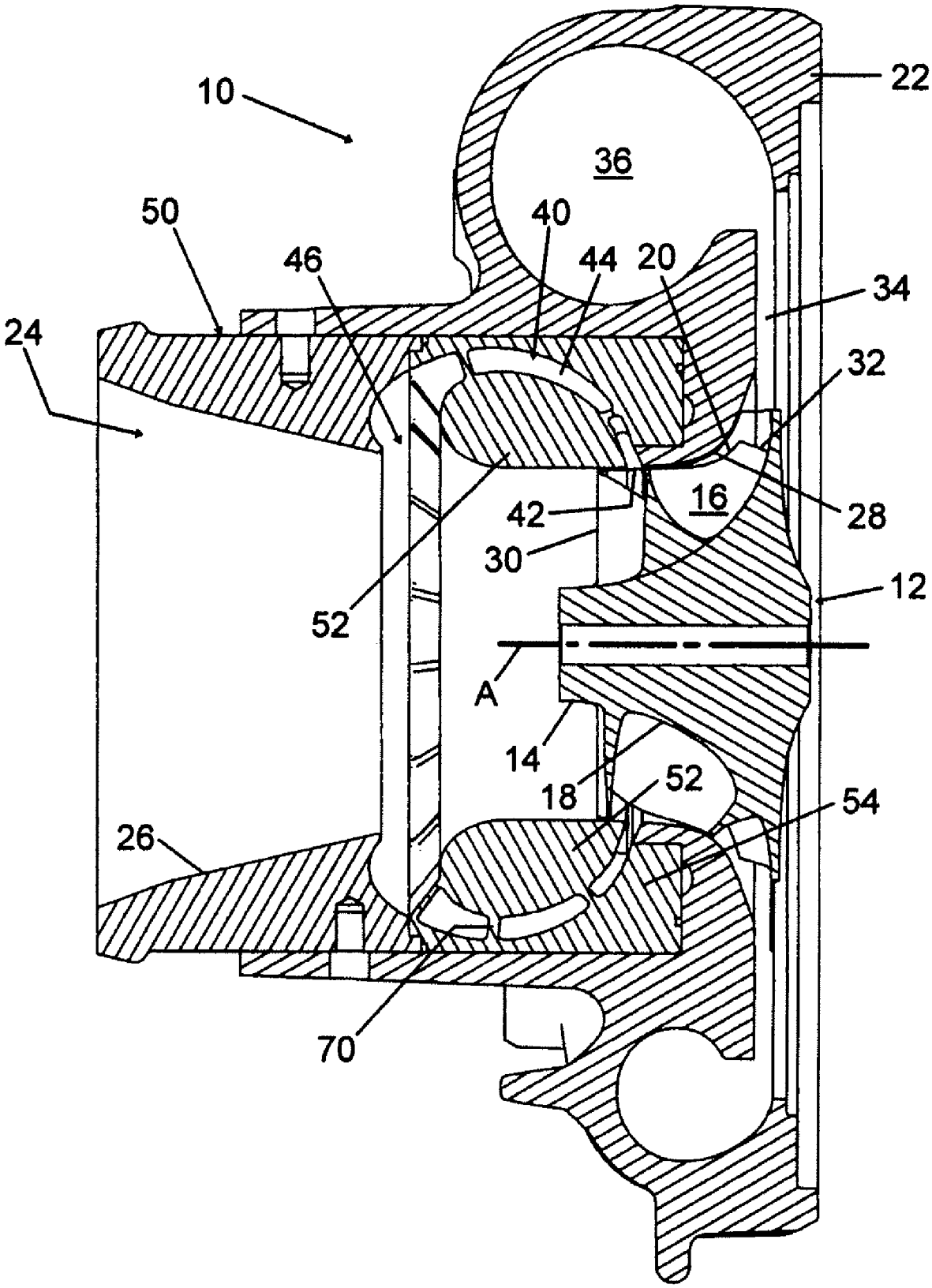
FIG. 1 is an axial-radial cross-sectional view of a centrifugal compressor in accordance with one embodiment of the invention.
Figure 2:
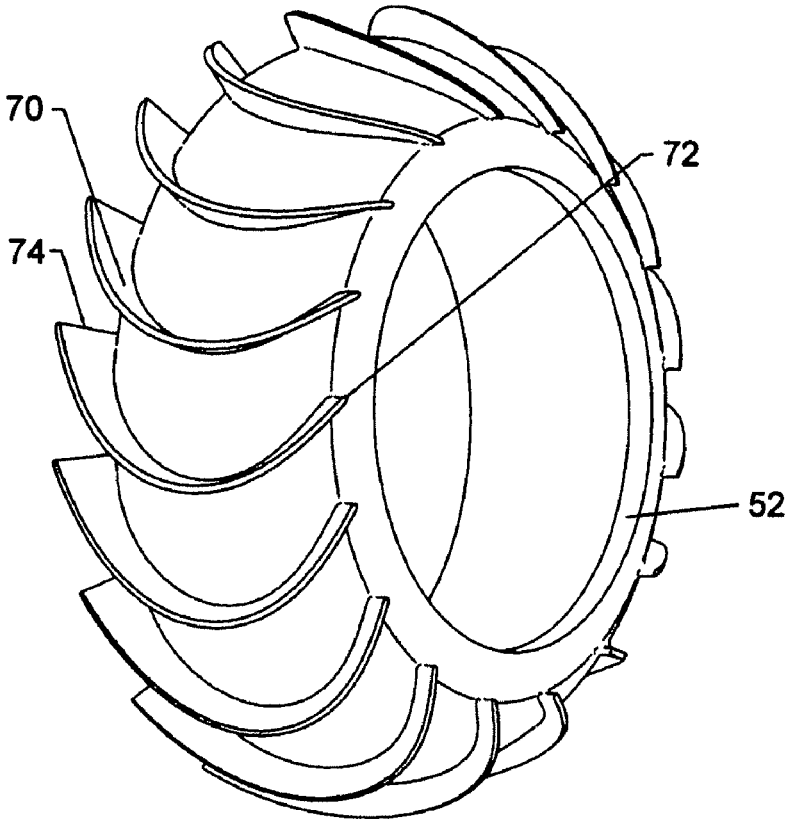
FIG. 2 is a perspective view of an inner ring and vanes of a bleed flow recirculation system used in the compressor of FIG. 1.
Figure 3:
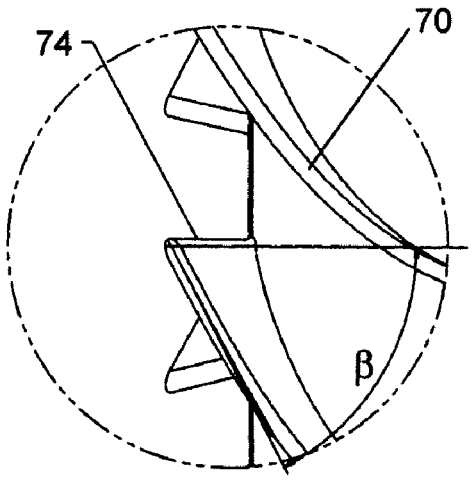
FIG. 3 is a magnified fragmentary view looking radially inwardly, showing a trailing edge region of one of the vanes.
Figure 4:
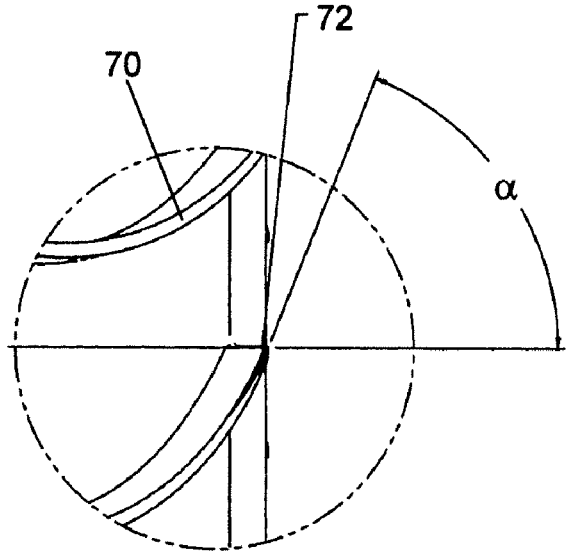
FIG. 4 is a magnified fragmentary view looking radially inwardly, showing a leading edge region of one of the vanes.
Figure 5:
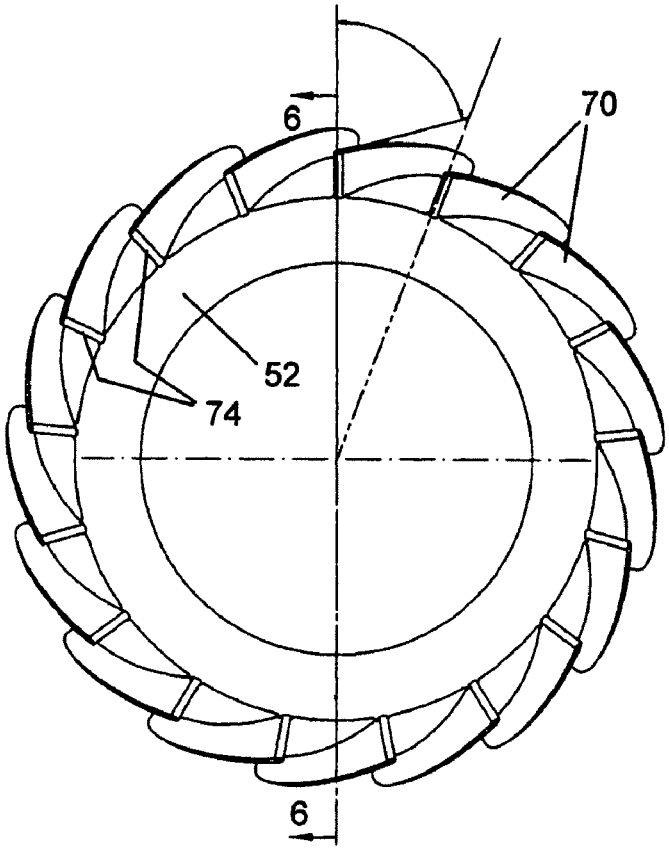
FIG. 5 shows the inner ring and vanes as viewed in an axial direction from the trailing edges toward the leading edges of the vanes (left-to-right in FIG. 1)
Figure 6:
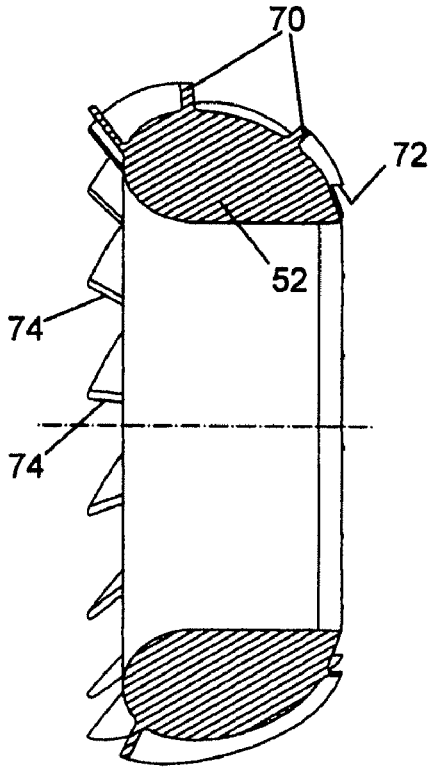
FIG. 6 is a cross-sectional view along line 6-6 in FIG. 5.

A centrifugal compressor 10 in accordance with one embodiment of the invention is depicted in meridional (i.e., axial-radial) cross-sectional view in FIG. 1. The compressor comprises a compressor wheel 12 having a hub 14 and a plurality of circumferentially spaced blades 16 joined to the hub and extending generally radially outwardly therefrom. Each blade has a root 18 attached to the hub and an opposite tip 20. The compressor wheel 12 is connected to a shaft (not shown) that is rotatable about a rotational axis A and is driven by a device such as a turbine or electric motor (not shown). The compressor wheel is mounted within a compressor housing 22. The compressor housing includes an inlet duct 24 having a radially inner surface 26 that encircles the axis A. The inlet duct 24 is configured such that the fluid flow approaches the leading edges 30 of the compressor blades 16 in a direction substantially parallel to the rotational axis A. The compressor housing further includes a wheel shroud 28 that is radially adjacent the tips 20 of the compressor blades. The flowpath defined by the hub and compressor housing is configured to turn the fluid flow radially outwardly as the fluid flows through the blade passages. The fluid exits the blade passages at the blade trailing edges 32 in a generally radially outward direction (although also having a swirl or circumferential component of velocity) and passes through a diffuser passage 34 into a discharge volute 36 that comprises a generally toroidal or annular chamber surrounding the compressor wheel.

The compressor 10 further includes a bleed flow recirculation system 40 for controlling surge of the compressor. The recirculation system includes a bleed port 42 defined in the radially inner surface of the compressor housing. The bleed port 42 is located intermediate the leading edges 30 and trailing edges 32 of the compressor blades. The bleed port in one embodiment is a substantially uninterrupted full 360° annular slot that encircles the tips of the compressor blades. As the fluid flows through the blade passages and is progressively compressed during its flow along the blade passages, a portion of the fluid flow is bled off through the bleed port 42. This bleed portion has been partially compressed by the compressor wheel and thus has a higher total pressure than the fluid entering the compressor inlet duct 24. The bleed portion also has a circumferential or swirl component of velocity because of the action of the rotating compressor blades.

The bleed port 42 is connected to a recirculation flow channel 44 defined in the compressor housing. In one embodiment, the recirculation flow channel 26 comprises a substantially uninterrupted full 360° annular passage, except for the presence of a plurality of vanes 70 as further described below. The recirculation flow channel 44 extends in a generally axial direction opposite to the direction of the main fluid flow in the inlet duct 24, to a point spaced upstream (with respect to the main fluid flow) of the compressor blade leading edges. The recirculation flow channel 44 at that point connects with a converging discharge end 46 that opens into the main fluid flowpath in the inlet duct 24.

The discharge end 46 in one embodiment is a substantially uninterrupted full 360° annular port. The discharge end 46 has a converging shape, meaning that its flow area decreases along the flow direction such that the bleed portion of fluid is accelerated before being injected into the inlet duct 24. In the illustrated embodiment, the discharge end is oriented such that the fluid is injected into the inlet duct with a downstream axial velocity component and a radially inward velocity component. The discharge end in the illustrated embodiment is oriented and configured such that the axial component of velocity is greater than the radial component of velocity.

In the illustrate embodiment, the recirculation flow system 40 is formed by an insert 50 that is formed separately from and installed in the compressor housing 22. The insert 50 forms the inlet duct 24 and extends substantially up to the leading edge region of the compressor wheel 12. The insert 50 defines an inner ring 52 of generally annular shape, an outer ring 54 of generally annular shape that is disposed generally radially outwardly of the inner ring 52, and a plurality of flow-turning vanes 70 that extend generally radially between a radially outer surface of the inner ring 52 and a radially inner surface of the outer ring 54. The bleed port 42 and the recirculation flow channel 44 are defined between these two surfaces of the inner and outer rings 52, 54. The recirculation flow channel 44 has a generally C-shaped configuration in axial-radial cross-section, with the open side of the C-shaped configuration facing radially inward.

In the illustrated embodiment, the direction of fluid injection from the discharge end 46 of the recirculation flow channel 44 forms an angle with the rotational axis A. Generally, the angle can be from about 0° (purely axial) to about 90° (purely radial). It is believed that surge suppression may be particularly facilitated by having some amount of axial velocity component, but purely radial injection is also beneficial.

The bleed port 42 is sized in flow area in relation to the flow area through the main fluid flowpath such that a substantial proportion of the total mass flow is bled off through the bleed port. For example, the bleed can be sized such that at a predetermined operating condition the bleed portion of the fluid comprises more than about 5% of the total mass flow, more particularly more than about 10% of the total mass flow, and in some cases more than about 15% of the total mass flow. The bleed portion can comprise up to about 30% of the total mass flow in some cases. As an example, the flow area of the bleed port can comprise about 5% to 30%, more particularly about 10% to 30%, and still more particularly about 15% to 30% of the flow area of the main gas flowpath at the bleed port location. The substantial proportion represented by the bleed portion of fluid means that the re-injected fluid directed by the discharge end 46 can influence a substantial portion of the compressor blades' span. This is in contrast to the types of compressor surge control techniques that have been employed in the past, in which the injected fluid typically may comprise only 1% to 2% of the total mass flow and thus influences only a localized region at the very tip of the blade. In accordance with the embodiments described herein, the recirculated injected fluid is able to influence a wide area of the flow field at the leading edges of the compressor blades. The injected fluid is able to cause a redistribution of the flow field and beneficially impact the surge phenomenon. It is further believed that imparting a substantial axial velocity component to the injected fluid, through the acceleration of the fluid by the discharge end and the orientation of the discharge end as described above, contributes to the ability to beneficially impact the surge phenomenon.

As indicated above, the recirculation system includes a plurality of vanes 70 arranged in the recirculation flow channel 44 for altering the degree of swirl in the bleed portion of the fluid before it is injected back into the main fluid flow stream. The bleed portion entering the bleed port 42 has a swirl component of velocity imparted by the rotating compressor blades. It is desirable to remove the swirl, and in some cases to reverse the swirl so as to impart counter-swirl in the bleed portion, before injecting the bleed portion back into the main fluid flow stream. The vanes 70 thus are highly cambered to accomplish the substantial amount of flow turning required. For example, in some cases it may be desirable for the bleed portion to be injected into the main fluid flow stream with zero swirl, and the vanes can be configured to accomplish that. In other cases it may be desirable to have non-zero counter-swirl, and the vanes can be configured accordingly. In the illustrated embodiment, the leading edges 72 of the vanes are spaced along the flow direction from the entrance to the bleed port 42, and the trailing edges 74 of the vanes are located upstream (with respect to the flow direction of the bleed portion) of the point at which the discharge end 46 begins to converge. In some embodiments of the invention, the ratio of the radius at the leading edges 72 of the vanes to the radius at the inlet to the bleed port 42 is greater than 1.05. However, alternative positions of the vanes are possible.

Figure 7:
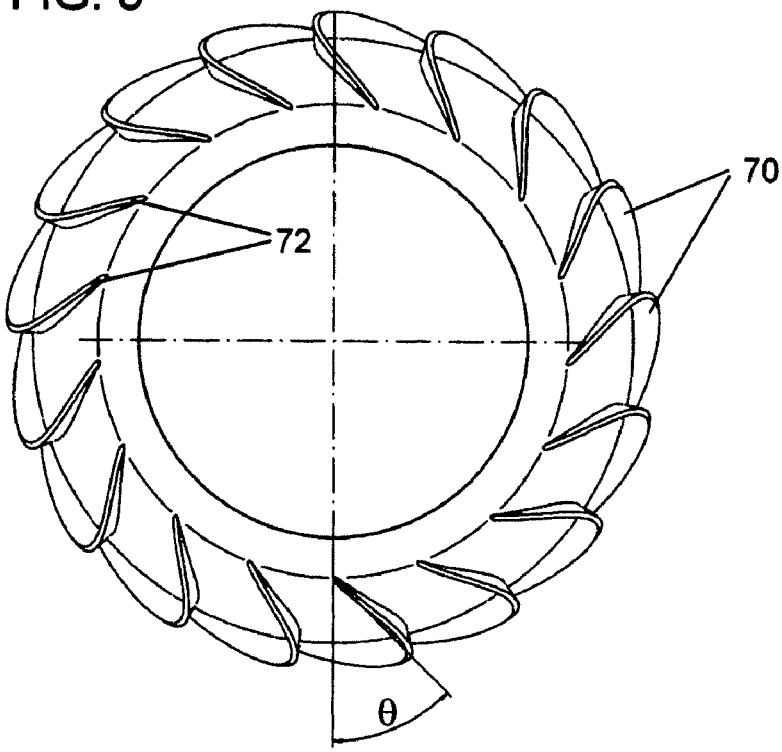
FIG. 7 shows the inner ring and vanes as viewed in an axial direction opposite to the direction of view in FIG. 5 (right-to-left in FIG. 1).

The vanes 70 are shown more clearly in FIGS. 2 through 7, which depict a portion of the insert 50, specifically, the inner ring 52 and vanes 70 (the outer ring 54 being omitted to allow an unobstructed view of the vanes). It can be seen that the vanes 70 are highly cambered and thus have a "cupped" configuration as viewed radially inwardly. In the illustrated embodiment, the leading edges 72 are located in the entrance portion of the recirculation flow channel 44. This entrance portion extends along a direction that is substantially radial but also has a non-zero axial component pointing upstream (to the left in FIG. 1) with respect to the main fluid flow stream in the compressor. The vanes extend from the leading edges 72 along a substantially radial direction before turning (in axial-radial cross-sectional view) along the generally C-shaped flow channel 44. Accordingly, as shown in FIG. 7, the leading edges 72 are oriented at an angle θ with respect to a radial direction. (If the leading edges were located in a portion of the flow channel that extends axially, the angle would be defined relative to the axial direction, e.g., see angle α in FIG. 4. More generally, the angle of a vane 70 at a particular point is defined as the angle between the vane's camber line at that point and a plane that contains that point as well as the rotational axis of the compressor, as viewed in a direction normal to a meridional stream surface at that point. Hereinafter, as well as in the appended claims, the terms "leading edge angle" and "trailing edge angle" are consistent with this definition.)

The leading edge angle θ can range from about 30° to about 75°, the particular value being dependent in part on the amount of swirl in the bleed portion. Generally, the leading edge angle is chosen so that the leading edges are generally aligned with the direction of flow of the bleed portion. Thus, if the bleed portion has a greater amount of swirl, the angle θ is larger; if the swirl is lower, then the angle θ is smaller.

As noted, the vanes 70 are configured to take out all of the swirl in the bleed portion, and in some cases to reverse the swirl so that the bleed portion has counter-swirl opposite to the rotation of the compressor wheel. To accomplish this, the vanes must have a relatively large amount of camber (i.e., change in angle of the camber line between the leading edge and the trailing edge). Accordingly, the trailing edge angle β of the vanes (FIG. 5) can range from about 0° (when zero swirl is to be imparted to the bleed flow leaving the vanes) to about 70° (when counter-swirl is to be imparted to the bleed flow). In some embodiments, the trailing edge angle β can range from about 10° to about 70°. Because there is typically a non-zero deviation angle between the trailing edge angle and the actual flow direction leaving the vanes, in some cases it may be necessary for the trailing edge angle β to have a small non-zero value (equal in magnitude to the deviation angle) when zero swirl is desired for the bleed portion flow leaving the vanes. The camber of the vanes is defined as θ+β. In some embodiments, the camber can range from about 30° to about 145°.

The highly cambered vanes 70 turn the swirling bleed portion as it progresses along the recirculation flow channel 44, taking out the swirl and in some cases imparting some amount of counter-swirl before the bleed portion is injected through the discharge end 46 into the main fluid stream in the inlet duct 24. Because of the large camber of the vanes, a relatively high vane count is employed in order to minimize the loss in the recirculation flow channel. Generally, there is an optimal vane count that depends on the vane camber and the diameter of the compressor wheel. In preferred embodiments, the vane count is between 6 and 20. In some embodiments, the vane count is defined as between 0.7 and 1.3 times the number of compressor blades.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A centrifugal compressor for compressing a fluid, comprising:

a compressor wheel defining a rotational axis and having a hub and a plurality of circumferentially spaced blades each joined to the hub and extending generally radially outwardly to a tip of the blade, each of the blades having a leading edge and a trailing edge;

a compressor housing in which the compressor wheel is mounted, the compressor housing including an inlet duct through which the fluid enters in a generally axial direction and is led into the compressor wheel, the compressor housing defining an inner surface located radially adjacent and outward of the tips of the blades;

the inner surface of the compressor housing defining a bleed port configured as a slot extending in a substantially uninterrupted fashion about a circumference of the compressor wheel for bleeding off a bleed portion of the fluid being compressed by the compressor wheel, the bleed port being located downstream of the leading edges of the blades such that the bleed portion enters the bleed port with a tangential velocity component imparted by the blades;

the compressor housing defining a recirculation flow channel that receives the bleed portion and conveys the bleed portion generally upstream with respect to a flow direction of a main fluid flow stream through the inlet duct, the recirculation flow channel having an entrance portion that extends from the bleed port along a direction that is generally radially outward but that has a non-zero axial component pointing upstream with respect to the flow direction through the compressor wheel, the recirculation flow channel having a discharge end arranged to discharge the bleed portion back into the main fluid flow stream approaching the compressor wheel; and a plurality of circumferentially spaced vanes disposed in the recirculation flow channel and configured to alter a degree of swirl in the bleed portion before being discharged through the discharge end, the vanes each having a leading edge and a trailing edge and having a non-zero camber, the leading edges extending in a non-axial direction generally corresponding to a flow direction of the bleed portion at the leading edges, the trailing edges extending in a direction such that the bleed portion is guided by the vanes to have zero swirl or counter-swirl when exiting the discharge end of the recirculation flow channel, wherein the leading edges of the vanes are located in the entrance portion of the recirculation flow channel.

2. The centrifugal compressor of claim 1, wherein the trailing edges of the vanes are oriented to impart zero swirl to the bleed portion leaving the vanes.

3. The centrifugal compressor of claim 1, wherein the vanes have a trailing edge angle of zero to about 70°.

4. The centrifugal compressor of claim 1, wherein the vanes have a trailing edge angle of about 10° to about 70°.

5. The centrifugal compressor of claim 1, wherein the vanes have a leading edge angle of about 30° to about 75°.

6. The centrifugal compressor of claim 1, wherein the flow area of the bleed port comprises from about 5% to about 30% of the flow area of the main fluid flow stream at the location of the bleed port.

7. The centrifugal compressor of claim 1, the discharge end of the recirculation flow channel being configured to inject the bleed portion in a direction that makes an angle of from 0° to 90° with respect to the rotational axis.

8. The centrifugal compressor of claim 1, wherein the vanes have a camber of about 30° to about 145°.

9. A centrifugal compressor for compressing a fluid, comprising:

a compressor wheel defining a rotational axis and having a hub and a plurality of circumferentially spaced blades each joined to the hub and extending generally radially outwardly to a tip of the blade, each of the blades having a leading edge and a trailing edge;

a compressor housing in which the compressor wheel is mounted, the compressor housing including an inlet duct through which the fluid enters in a generally axial direction and is led into the compressor wheel, the compressor housing defining an inner surface located radially adjacent and outward of the tips of the blades;

the inner surface of the compressor housing defining a bleed port configured as a slot extending in a substantially uninterrupted fashion about a circumference of the compressor wheel for bleeding off a bleed portion of the fluid being compressed by the compressor wheel, the bleed port being located downstream of the leading edges of the blades such that the bleed portion enters the bleed port with a tangential velocity component imparted by the blades;

the compressor housing defining a recirculation flow channel that receives the bleed portion and conveys the bleed portion generally upstream with respect to a flow direction of a main fluid flow stream through the inlet duct, the recirculation flow channel having a discharge end arranged to discharge the bleed portion back into the main fluid flow stream approaching the compressor wheel, wherein a flow area of the recirculation flow channel decreases approaching the discharge end such that the bleed portion is accelerated before being injected into the main fluid flow stream; and a plurality of circumferentially spaced vanes disposed in the recirculation flow channel and configured to alter a degree of swirl in the bleed portion before being discharged through the discharge end, the vanes each having a leading edge and a trailing edge and having a non-zero camber, the leading edges extending in a non-axial direction generally corresponding to a flow direction of the bleed portion at the leading edges, the trailing edges extending in a direction such that the bleed portion is guided by the vanes to have zero swirl or counter-swirl when exiting the discharge end of the recirculation flow channel.

10. A centrifugal compressor for compressing a fluid, comprising:

a compressor wheel defining a rotational axis and having a hub and a plurality of circumferentially spaced blades each joined to the hub and extending generally radially outwardly to a tip of the blade, each of the blades having a leading edge and a trailing edge;

a compressor housing in which the compressor wheel is mounted, the compressor housing including an inlet duct through which the fluid enters in a generally axial direction and is led into the compressor wheel, the compressor housing defining an inner surface located radially adjacent and outward of the tips of the blades;

the inner surface of the compressor housing defining a bleed port configured as a slot extending in a substantially uninterrupted fashion about a circumference of the compressor wheel for bleeding off a bleed portion of the fluid being compressed by the compressor wheel, the bleed port being located downstream of the leading edges of the blades such that the bleed portion enters the bleed port with a tangential velocity component imparted by the blades;

the compressor housing defining a recirculation flow channel that receives the bleed portion and conveys the bleed portion generally upstream with respect to a flow direction of a main fluid flow stream through the inlet duct, the recirculation flow channel having a discharge end arranged to discharge the bleed portion back into the main fluid flow stream approaching the compressor wheel, wherein the recirculation flow channel has a generally C-shaped configuration in axial-radial cross-section, an open side of the C-shaped configuration facing radially inwardly; and a plurality of circumferentially spaced vanes disposed in the recirculation flow channel and configured to alter a degree of swirl in the bleed portion before being discharged through the discharge end, the vanes each having a leading edge and a trailing edge and having a non-zero camber, the leading edges extending in a non-axial direction generally corresponding to a flow direction of the bleed portion at the leading edges, the trailing edges extending in a direction such that the bleed portion is guided by the vanes to have zero swirl or counter-swirl when exiting the discharge end of the recirculation flow channel.

* * * * *